United States Patent [19]

Siegwart

[11] 4,058,997

[45] Nov. 22, 1977

[54] APPARATUS FOR MANUFACTURING TUBES

[76] Inventor: Emil Siegwart, 6 Michael Blatter Strasse, Sulzbach-Neuweiler, Germany

[21] Appl. No.: 784,521

[22] Filed: Apr. 4, 1977

Related U.S. Application Data

[63] Continuation-in-part of Ser. No. 630,256, Nov. 10, 1975, abandoned.

[30] Foreign Application Priority Data

Nov. 13, 1974 Germany ..... 2453876

[51] Int. Cl.[2] ..... B21C 37/12

[52] U.S. Cl. ..... 72/50; 72/137; 72/145

[58] Field of Search ..... 72/49, 50, 135, 137, 72/140, 145, 368; 228/145

[56] References Cited

U.S. PATENT DOCUMENTS

| | | | |
|---|---|---|---|
| 1,955,410 | 4/1934 | Colbie | 72/50 |
| 3,417,587 | 12/1968 | Campbell | 72/50 |
| 3,595,046 | 7/1971 | Malkki et al. | 72/49 |
| 3,621,884 | 11/1971 | Trihey | 72/49 |
| 3,677,047 | 7/1972 | Holyoake et al. | 72/50 |
| 3,753,363 | 8/1973 | Trihey | 72/50 |
| 3,863,480 | 2/1975 | Meserole | 72/50 |
| 3,982,414 | 9/1976 | Anderson | 72/50 |

*Primary Examiner*—E. M. Combs
*Attorney, Agent, or Firm*—Hill, Gross, Simpson, Van Santen, Steadman, Chiara & Simpson

[57] ABSTRACT

This invention relates to apparatus for manufacturing tubes by the helical coiling of a strip into successive convolutions. The strip is preferably of a corrugated sheet metal. The coiling means of the apparatus comprises a plurality of nondriven freely rotatable and radially adjustable guide rollers adapted to guide and support the strip during the formation of a convolution. These rollers are arranged on a circle so that they engage the convolution at its outside. Arranged at the point of the strip entry into the coiling means is an inner and an outer connecting roller, the inner connecting roller positioned within and the outer connecting roller positioned outside the circle on which the guide rollers are situated. The connecting rollers have the purpose of joining a convolution after its travel past the guide rollers to the incoming strip so that convolution and strip overlap each other. By controlling peripheral rotational speed of the connecting rollers and providing the connecting rollers with various surface configurations, the joint between the incoming strip and the just formed convolution can be controlled to insure a proper joining therebetween as well as dimensional control of the diameter of the tube being formed.

11 Claims, 6 Drawing Figures

APPARATUS FOR MANUFACTURING TUBES

This application is a continuation-in-part of previously filed application U.S. Ser. No. 630,256, filed Nov. 10, 1975, abandoned.

BACKGROUND OF INVENTION

1. Field of Invention

The present invention relates to apparatus for manufacturing tubes by helical coiling of a preferably corrugated strip, in particular a sheet metal strip, comprising coiling means equipped with two connecting means arranged at the strip-entering point and acting on a surface of the two strips to mutually join the adjacent convolution of the tube, then means to guide said joined strip in a circle to produce a next convolution.

2. Description of the Prior Art

A device of the aforedescribed class is already known (cf. German patent application laid open to public inspection DT-OS No. 2,453,876). This document discloses the means geared to move said strip in a circle to produce a convolution, which is composed of supporting rollers arranged at the periphery of the convolution to be produced and serving to guide same; these supporting rollers are paraxially arranged at a support for free rotation. To achieve a compensation for different values of strip thickness the supporting rollers can be geared for radial adjustment at the support, relative to their circular arrangement.

It has become apparent that the known devices cannot always produce tubes having exactly the desired tube diameters; this is true particularly for different strip qualities, and above all for different values of strip thickness or bending resistance. Since in one and the same strip deviations in quality cannot be avoided either, the diameters of the convolutions are frequently different, too, in tubes produced in the known devices.

SUMMARY OF INVENTION

The objective underlying the present invention is to provide the simplest construction possible in apparatus of the type specified by way of introduction, wherein tubes can be produced whose diameter constantly coincides with the desired values.

In accordance with the present invention this objective is achieved by connecting rollers driven to have different peripheral speeds. In an expedient embodiment the rotational speed of the connecting roller can be varied, which is arranged at the inner side of the convolution or tube to be produced whilst the connecting roller provided at the outside of this convolution or tube can be driven at a constant rotational speed.

By a corresponding change of the peripheral speeds of the connecting rollers it is possible to oppose an increase in convolution diameter, which is entailed by a changing strip quality. Such effect is obtained by giving a higher peripheral speed, for instance, to the connecting roller provided at the side of the strip convolution, so that the strip convolution superimposing the strip entering in coiling direction is given a feed velocity higher than that of the entering strip; this feature entails reduction of the convolution diameter.

If, on the other hand, the convolution diameter starts to decrease, the peripheral speed of that connecting roller is reduced which is provided at the side of the convolution diameter at the strip-entering point; in this way the feed velocity of the convolution superimposing the strip convolution is so reduced that the diameter of convolution is increased.

To be able to control the peripheral speeds of the connecting rollers in a way that undesired deviations in the respective convolution diameter are opposed, it is possible to provide contact sensors at the periphery of the strip convolution to be produced, such sensors being coupled with means for variation of the rotational speed of one or either connecting roller. Such contact sensors can be arranged at the outside or at the outside and inside of the strip convolution. When the diameter of convolution starts to increase, one, i.e. the one arranged at the outside of the strip convolution, of the contact sensors is pressurized by the strip convolution; the contact sensor in its turn controls the driving means for the connecting rollers in a manner that the beginning increase in diameter is opposed.

If, in a known manner, the coiling apparatus is provided with guide rollers for the strip, which are arranged at the convolution periphery, one or several of these guide rollers can be designed as contact sensors, for this purpose.

In certain cases it can also be expedient to achieve different or variable peripheral speeds of the connecting rollers not by a change of the rotational speed but by application of different or variable roller diameters. Such different or variable roller diameter may be, but need not be, tied in with a variation of the rotational speed of the connecting rollers. When, for instance, the production of coiled tubes conically tapering in axial direction is intended, a constant ratio of a different rotational speed of either connecting roller can be desired so that hence a constant variation of the peripheral speed is not decisive.

DESCRIPTION OF THE PREFERRED EMBODIMENT

Figure 1:
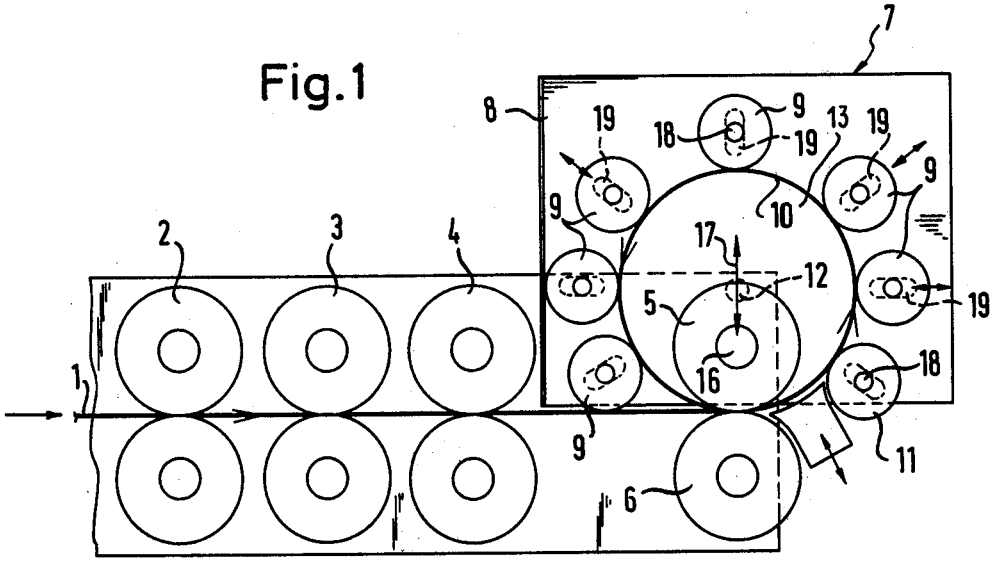
FIG. 1 is an elevational view of the preferred embodiment of the apparatus according to the invention.

An apparatus according to the invention as shown in the drawings includes a strip 1, which is to be coiled into a tube 13, guided in a straight line between a series of rollers 2, 3 and 4 arranged in pairs one after another in the direction of strip movement. As the strip 1 passes through the rollers 2, 3 and 4, it is longitudinally corrugated. After leaving rollers 4, the strip 1 enters between two connecting rollers 5 and 6. The axes of the rollers 5 and 6 are positioned parallel to those of the rollers 2, 3 and 4 and have the purpose of connecting an adjacent convolution 10 to the strip 1.

The connecting rollers 5 and 6 may be so formed that the interengaging corrugations of the incoming strip 1 and of the convolution 10 which is superposed onto the strip 1 are compressed in such a way that these corrugations assume a proximate dovetailed shape in cross section, i.e. the corrugations are wider at their top than at their bottom as is explained in our co-pending British Patent Application No. 30263/73. The strip 1 and the corrugation form therefore together a compression joint.

A coiling means 7 includes a support plate 8 on which a number of guide rollers 9 are arranged in a circle. The connecting rollers 5 and 6 are positioned such that the peripheral surface of the connecting rollers 5 and 6 is substantially tangential to the circle formed by guide rollers 9. The one connecting roller 5 is located inside the circle and the other connecting roller 6 at its outside. After passing between the rollers 5 and 6, the strip 1 travels past the guide rollers 9 and at the same time is deflected by them into a circular convolution. The deflection of the strip 1 is initiated immediately after the strip 1 leaves the rollers 5 and 6 by a deflecting roller 11 arranged on the support plate 8 so that the axis of that roller 11 is parallel to those of the guide rollers 9.

Figure 2:
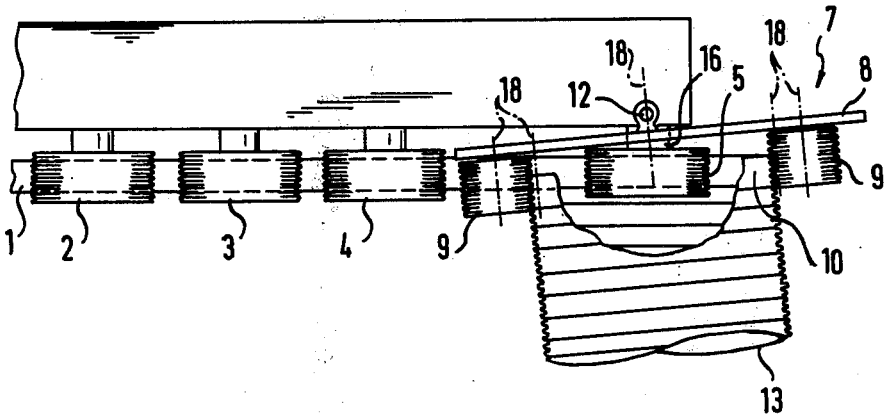
FIG. 2 is a plan view of the apparatus of FIG. 1.

Since the strip 1 has to be coiled helically to produce the tube 13 as desired, the support plate 8 is capable of being pivoted about a shaft 12 which is positioned perpendicular to the plane of the incoming strip 1. In this way the support plate 8 can be set in an oblique position relative to the longitudinal axis of the incoming strip 1 as required by the pitch of the helical convolutions of the tube to be produced. Since the deflecting roller 11 and the guide rollers 9 are secured to the plate 8 and the plate 8 is freely rotatable about the shaft 12, rotation of the plate 8 causes a change in the oblique position of the guide rollers 9 and the deflecting roller 11 as shown in FIG. 2. The guide rollers 9 and the deflecting roller 11 are thus able to adapt to the pitch of the convolutions 10 of the tube 13 being produced.

After a complete convolution has been formed, this convolution 10 is again passed between the connecting rollers 5 and 6. A portion of the outer surface of the corrugations in the convolution 10 interface with a portion of the inner surface of the incoming strip 1 so that the convolution 10 is offset axially relative to the strip 1 by the amount called for by the pitch of coiling. These offsets between successive convolutions gradually build to create the tube 13.

In order to cause the convolution 10 to be offset in the manner required after it has passed through the coiling means 7, the convolution 10 is directed axially by the guide roller 9 in addition to being radially supported on the outer peripheral surface of each. The axial guiding may be obtained in a positive manner by means of an annular flange or a lip extending around the periphery of a guide roller 9, the flange engaging the unconnected edges of the convolution 10. Axial guiding of the strip 1 to produce convolution 10 also may be obtained by providing like corrugations in the guide rollers 9 which engage the corrugations in the strip 1.

Figure 3:
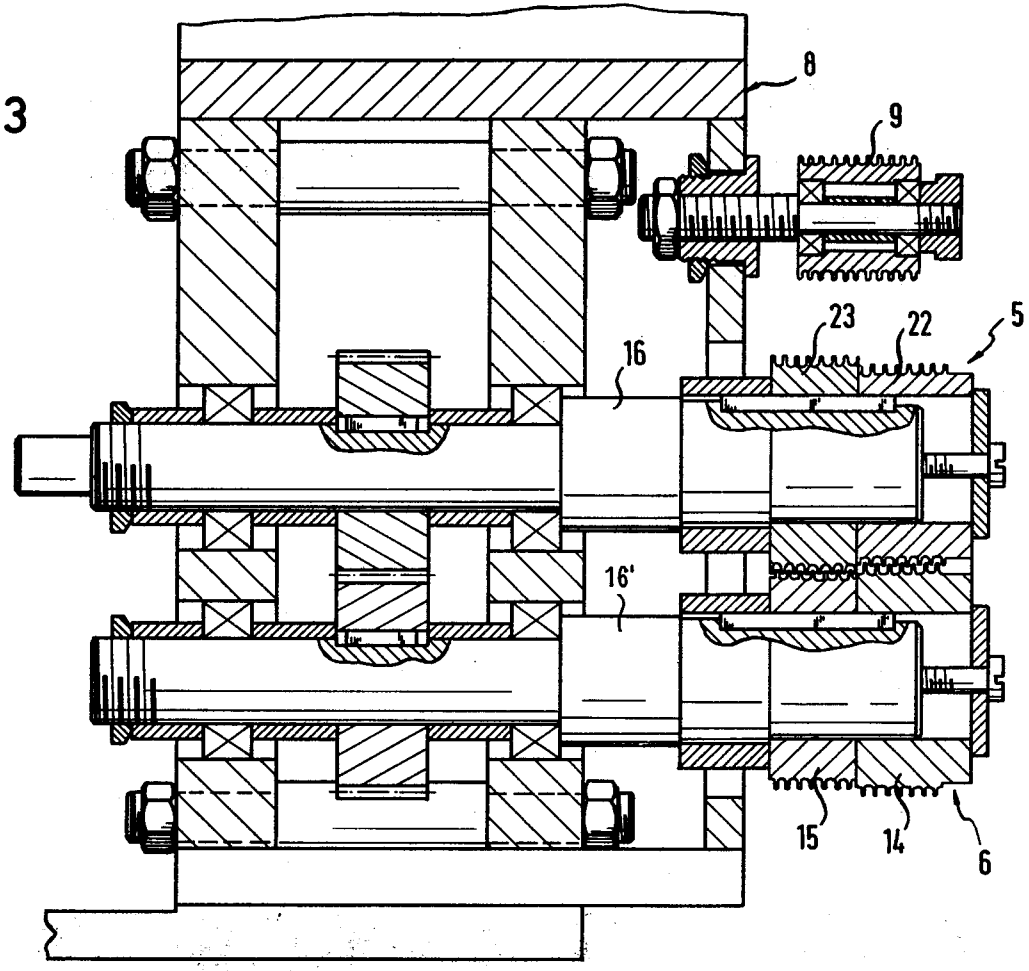
FIG. 3 is an elevational section through the apparatus shown in FIGS. 1 and 2, the section taken through the connecting rollers and their drives.

As can be seen from FIG. 3 of the drawings, the connecting rollers 5 and 6 are divided in their axial direction into two parts 22, 23 and 14, 15, respectively. As the tube 13 is built up in a direction parallel to the axes of the rollers 5 and 6, each of these two rollers has a part which trails and another part which leads with respect to the direction of tube build-up.

The parts 22, 23 as well as the parts 14, 15 are of different diameters and are fixedly mounted on drive shafts 16 and 16', respectively, the trailing part 22 of connecting roller 5 being of smaller diameter than the leading part 23, while conversely the trailing part 14 of connecting roller 6 is of corresponding greater diameter than the leading part 15. The incoming strip 1 is so guided between the rollers 5 and 6 that it is engaged across its width by both parts of each of the rollers 5 and 6. Depending on its desired pitch, a convolution 10 is, after passing the deflecting roller 11, guided back between the connecting rollers 5 and 6 in such a manner that it passes between the parts 22 and 14 of those rollers it can also be expedient that the part 15 or the part 23 may be freely mounted and undriven as shown for part 33 in FIG. 4.

The difference in diameter between parts 22 and 23 of connecting roller 5 and parts 14 and 15 of connecting roller 6 causes a convolution on passing again through the connecting rollers 5 and 6 to be driven at a faster rate than the incoming strip 1 by part 14 of the lower connecting roller 6 as a consequence of the greater diameter of that part. Because of this, the incoming strip 1 is thrust firmly against the guide rollers 9 and the deflecting roller 11 in the radial direction of the convolution 10 which is with one half in contact with the rollers 5 and 6. The frictional grip between the connecting rollers 5 and 6 or more precisely between their parts 22, 23 and 14, 15 of one part and the strip 1 of another part is, however, sufficiently slack to allow a certain amount of slip.

Because of the difference in diameter between the parts 22, 23 and 14, 15 respectively the strip 1 is further formed by the connecting rollers 5 and 6 with a longitudinal shoulder or step and this, together with the elasticity and flexibility of the strip 1, assists in preventing the diameter of the tube from increasing as coiling progresses and this notwithstanding the interengagement between adjacent convolutions 10 of the tube 13.

If a tube 13 is to be produced in which the pitch of the convolution 10 amounts to only a third of the width of the strip instead of a half, it is advantageous for the connecting rollers 5 and 6 to be each divided axially into three parts, the diameters of these parts becoming greater from part to part in the direction of tube formation in the case of the outer roller 6 and smaller in the case of the inner roller 5. The part 22 of the connecting roller 5 is fixedly mounted on a drive shaft 16 and revolves synchronously with the other part. The part 15 of the connecting roller 6 is freely mounted and undriven on a shaft 16'.

Figure 4:
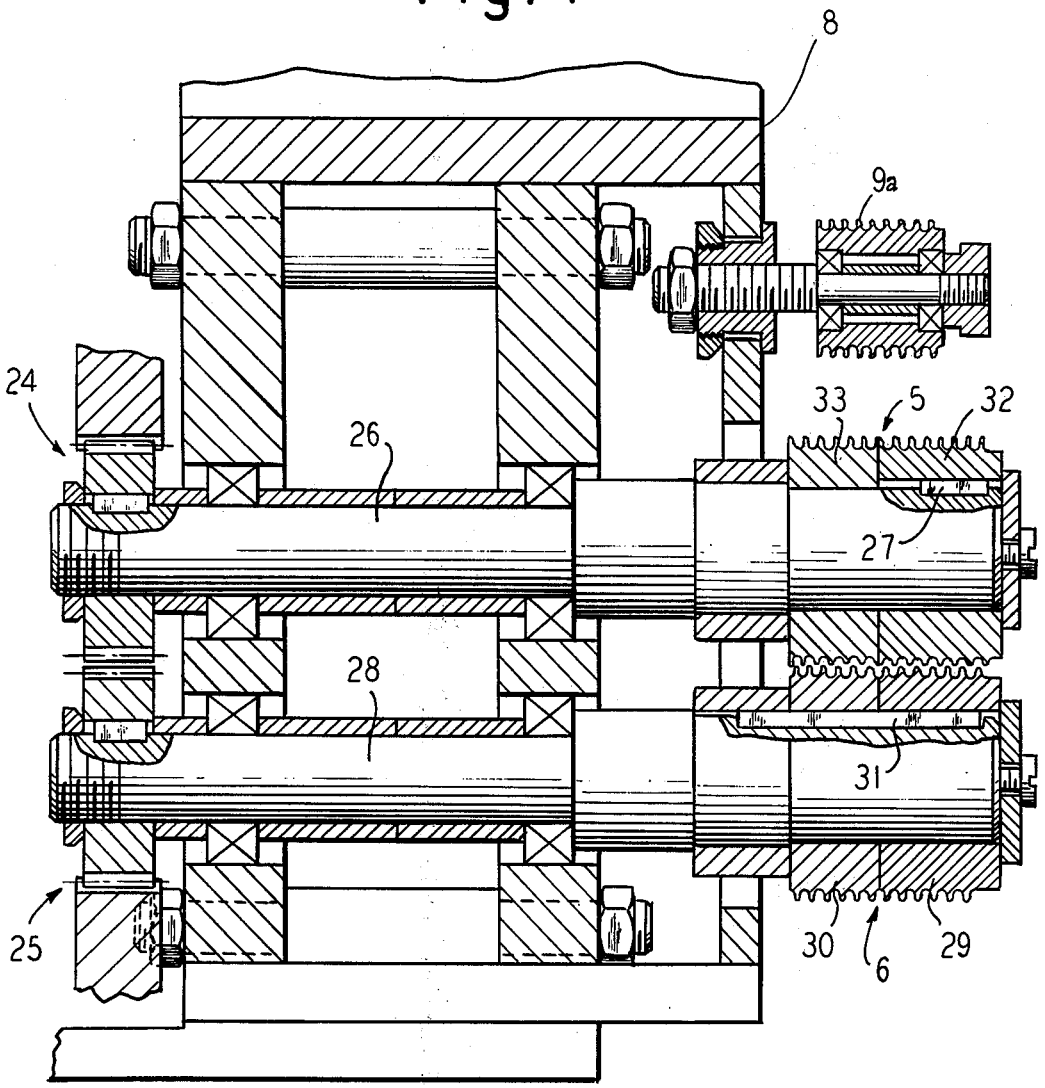
FIG. 4 is an elevational section through an alternate configuration of the section taken through the connecting rollers and their drives.

FIG. 4 shows an alternative configuration of connecting rollers 5, 6. In this embodiment the inner connecting roller 5 is carried by an inner shaft 26 and the outer connecting roller 6 is carried by an outer shaft 28. The outer and inner connecting rollers are divided into two parts 29, 30, 32 and 33. Thus roller parts 29 and 30 of the outer connecting roller 6 and the roller part 32 of the inner connecting roller 5 are connected with the respective shafts 28 or 26 by a wedge or key 27 or 31, respectively, this connection not permitting any rotation between the respective shaft and roller part. On the other hand, the other roller part 33 of the inner connecting roller 5 is arranged for free rotation on shaft 26. The diameter of each roller part 29, 30, 32 and 33 and of both connecting rollers 5 and 6 is the same.

In the embodiment shown in FIG. 4, the supporting roller **9*a*, which is arranged vertically above the two connecting rollers 5, 6, can be designed to be pressure sensitive. If the diameter of convolution starts to increase for reasons of the characteristics of strip material 1 in coiling the strip 1, this increase being produced in the coiling means, the convolution 10 exerts an increased pressure onto the pressure sensitive roller 9*a***.

Such increased pressure is utilized in the embodiment shown in FIG. 4 to increase the rotational speed of the connecting roller 5 provided at the inner side of the convolution. To this end the two connecting rollers 5, 6 are each associated with an independent drive 24, 25, respectively. At least the drive 24 for connecting roller 5 is so designed that it can serve to change the peripheral speed of this roller, since roller 9*a* is operatively connected, by control means (not shown), to drive 24.

The higher peripheral speed of inner connecting roller 5, which is caused by the roller 9*a*, entails an increase of the advancing speed of the convolution 10 superposed on the strip 1 entering the coiling means, such that the convolution advancing speed is higher than the advancing speed of the strip 1. Such provision entails a reduction of the diameter of the convolution passing through the two connecting rollers 5, 6. When, however, the convolution 10 starts to become smaller, the pressure exerted by the convolution onto the roller 9*a* decreases. When the roller 9*a* senses such a decrease in pressure, it actuates said control means which emits a stepping contact pulse to the drive 24 of connecting roller 5 in a way that this drive 24 decreases the peripheral speed of the associated connecting roller 5. Hence, the advancing speed of the convolution 10, which is coiled onto the strip 1 in the coiling means 7, is reduced relative to the advancing speed of the entering strip 1. Such speed decrease entails an increase of the diameter of the convolution passing through the two connecting rollers 5, 6.

It is also possible to provide an independent pressure sensitive roller at the inner side of convolution 10 for this sensing operation. This pressure sensitive roller can, for instance, be arranged opposite to the aforementioned roller 9*a* arranged at the outer side of the convolution 10.

Such control of the peripheral speed of the inner connecting roller 5 allows coiling of a tube having a precisely controlled diameter with exactly the desired tube caliber even in case of irregularities or different characteristics in the material of strip 1. The aforementioned construction also allows production of coiled tubes having the same diameter even if strips of different quality and thickness are employed for such tubes.

It is, of course, possible on principle to achieve a constant diameter of convolutions 10 also by control of the peripheral speed of the outer connecting roller 6 when such control can contribute to control the advancing speed of the entire strip entering the coiling means 7.

A corresponding control of the peripheral speed of connecting rollers 5, 6 in the apparatus according to the present invention also permits production of conical tubes whose diameter decreases or increases in the direction of the tube axis. In such a case it is only necessary to set the pressure sensitive rollers correspondingly.

It is also possible to provide other pressure sensitive contacts instead of the roller freely rotating along with the convolution 10.

In the case of a coiled tube, it is normally required to make provisions for interconnection of successive strip convolutions in their area of overlap.

To this end connecting rollers 5 and 6 may be so formed that the interengaging corrugations of the incoming strip 1 and of the convolution 10, which is superposed onto strip 1, are compressed in such a way that these corrugations assume an approximate dovetailed shape in cross section, i.e. the corrugations are wider at their top than their bottom, as is explained in our co-pending British Patent Application No. 30263/73.

It is also possible to press the interengaging corrugations of two adjacent convolutions to achieve flat folded edges (cf. U.S. Pat. No. 3,858,421).

In both these cases an interengagement or hooking of the mutually enclosing corrugations in achieved which prevents a sliding separation and hence a separation of the overlapping areas of the strip convolutions.

Figure 5:
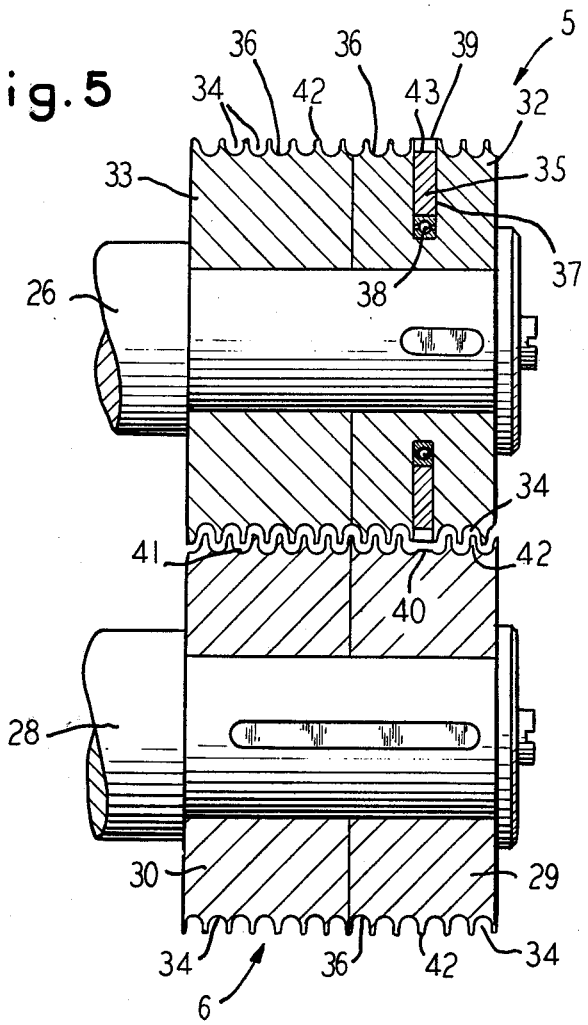
FIG. 5 is an elevational section through the axes of the connecting rollers in another embodiment.
Figure 6:
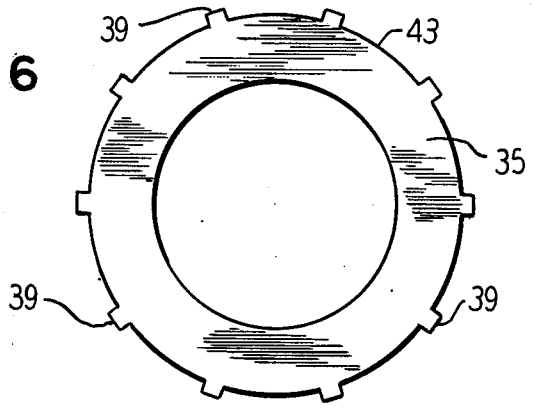
FIG. 6 is a view of a fastening (pressure) disk used in the connecting rollers as shown in FIG. 5.

As best seen in FIGS. 5 and 6, such hooking can be achieved by the inner connecting roller 5 supported on an inner drive shaft 26 including freely rotatable first inner roller part 33 and a second outer roller part 32 joined to the shaft 26 in a fixed manner. The first and second roller parts 33 and 32 are formed having a series of circumferent grooves 34 having a bottom 36 and apex 42. The second outer roller part 32 has an annular space 37 in which is disposed a disk 35 made freely rotatable by a bearing 38 positioned within the space 37.

The disk 35 has an outer peripheral surface 43 which includes a series of cam projections 39 spaced at fixed intervals about the surface 43.

A diameter of the surface 43 of the disk 35 is proximate a diameter of the connecting roller 5 as measured between opposing groove bottoms 36 while a diameter of the disk 35 as measured between the camming projections 43 proximates a diameter of the connecting roller 5 as measured between opposing apexes 42.

The outer connecting roller 6 is supported on the outer drive shaft 28 in a fixed manner and includes a first inner roller part 30 and a second outer roller part 29. Each roller part 30 and 29 also is formed having a series of circumferent grooves 34 having an apex 42 and a groove bottom 36. The grooves 34 of the inner and outer connecting rollers 5 and 6 are offset so that the apexes 42 of the grooves 34 of the outer connecting roller 6 align with the groove bottom 36 of the groove 34 of the inner connecting roller 5.

The groove 34 in the outer connecting roller 6 opposite the disk 35 has a flattened apex 40 to provide a support surface for the projections 43 of the disk 35.

In such movement, the apexes of the conformingly enclosing corrugations are broadened in such a way that an approximate dovetailed corrugation cross section is obtained. Such cross section entails hooking of the conformingly enclosing corrugations so that undesired separation of the two convolutions is definitely prevented.

Since the conformingly superposed corrugations of two adjacent convolutions can be mutually hooked or joined only on completion of a full coil of convolution 10, in order to still allow for the inventive correction of the convolution diameter the disk serving to hook the corrugations must be arranged for free rotation independent of the connecting roller 5.

The freely rotatable disk 35 can be provided also with acute teeth or thorn-shaped projections instead of cams 39. Such acute hooking elements perforate the superposed convolutions so that the latter are also connected with each other by clamping or stapling. In such a case the outer connecting roller 6 must be provided with deep indentations or recesses to match the acute teeth of the inner connecting roller 5 in the corresponding area, which indentations are suited for accommodation of the teeth of the thorned disk. Such construction enables one convolution to be fixedly attached to the adjacent convolution which partly is superposed to the first convolution, even in a case where the strip is not corrugated.

While various modifications may be suggested by those versed in the art, it should be appreciated that I wish to embody within the scope of the patent warranted hereon, all such modifications as reasonably and properly come within the scope of my contribution to the art.

I claim as my invention:

1. Apparatus for manufacturing tubes by helically coiling a metal strip having longitudinal corrugations comprising, coiling means including two connecting means positioned and carried by said apparatus at a strip entering point, said connecting means spaced to act on a top and a bottom surface of said strip and a just formed convolution to mutually join said strip and said convolution, means carried by said apparatus to guide said mutually joined strip and said convolution in a circle, and driving means connected to said two connecting means to drive them at differing peripheral velocities with respect to a longitudinal velocity of said strip and a rotational velocity of said convolutions.

2. In an apparatus for producing a tube from a continuous strip travelling at a first velocity by helically coiling said strip into a continuous plurality of convolutions comprising, a. an apparatus body, b. connecting means adapted to receive said continuous strip and join an edge portion thereof with an adjacent edge portion of a just formed convolution into a joint, said means including an inner and outer connecting roller rotatively carried by said body to intersect tangentially with an inner and outer peripheral surface of said tube, and c. driving means connected to said connecting rollers to drive said rollers at peripheral velocities differing from said first velocity of said strip and a rotational velocity of said convolutions.

wherein characteristics of said joint are controlled in relation to a magnitude of said velocity differences.

3. An apparatus as defined in claim 2 and further characterized by, said inner connecting roller comprising a first and a second roller part, said first roller part having a diameter greater than a diameter of said second part to create an offset of an adjacency of said parts, said outer connecting roller comprising a first roller part and a second roller part, said first roller part having a lesser diameter than a diameter of said second outer roller part to create an offset at an adjacency of said parts, said first and second roller parts of said inner connecting roller carried on an inner drive shaft in a fixed position, said first roller part of said outer connecting roller freely carried on an outer drive shaft and said second roller part of said outer connecting roller carried on said outer drive shaft in a fixed position, driving means connected to said inner and outer shafts to drive said shafts at an equal number of revolutions per unit of time, wherein said first and second roller parts of said inner and outer connecting rollers have a different peripheral velocity with respect to the velocity of said strip as said roller parts engage and drive said strip to create an offset joint between said incoming strip and said adjacent convolution.

4. An apparatus for forming a tube by continuously coiling into a helical convolution a metal strip having longitudinal corrugations comprising:

an apparatus structure, guide means to direct said strip into said apparatus, a vertical support plate carried by said structure and obliquely aligned with the longitudinal axis of said strip, coiling means carried by said plate and including, an inner connecting roller and an outer connecting roller rotatively carried by and positioned transversely to a vertical axis of said plate and spaced to provide an opening for said strip and said convolution and join said strip to said convolution in a fixed relationship, a plurality of rotatable guide rollers on said plate to guide said convolution, said guide rollers having axes forming a circle with said inner and outer connecting rollers positioned on said plate tangentially to said circle, and a source of rotary power operatively connected to said connecting rollers and driving said rollers to have peripheral surface velocities differing from a velocity of said strip and said convolution in contact therewith.

5. An apparatus as defined in claim 4 and further characterized by, said inner connecting roller comprising a plurality of adjacent cylindrical-shaped roller parts, each said part having a progressively smaller diameter as a distance from said plate to said part increases, and said outer connecting rollers comprising a plurality of adjacent cylindrically-shaped roller parts, each said part having a progressively greater diameter as a distance from said plate to said part increases, said roller parts of said inner and outer connecting rollers positioned to form an offset at their adjacency.

6. An apparatus for producing a tube from a strip by the continuous helical coiling of said strip in a plurality of joined convolutions comprising, a. an apparatus body, b. means carried by said body for joining an inner surface portion of said strip to an outer surface portion of a just formed convolution, said means including inner and outer connecting rollers having parts in contact with said strip and said just formed convolution, and c. driving means connected to said connecting rollers to drive said rollers at peripheral velocities differing from a longitudinal velocity of said strip and a rotational velocity of said convolutions, wherein said tube is formed having a tight joint between adjacent convolutions and said convolutions are constant in diameter.

7. An apparatus as defined in claim 6 and further characterized by, said inner connecting roller comprising a first and second roller part, said first part carried by an inner drive shaft in a rotative manner and said second roller part carried by said inner drive shaft in a fixed manner, said outer connecting roller comprising a first and second roller part carried by an outer drive shaft in a fixed manner, said diameters of said first and second roller parts of said inner and outer connecting rollers having similar diameters.

8. An apparatus as defined by claim 7 and further characterized as including, said driving means being adjusted and connected to said inner and outer drive shafts to drive said shafts at varying rotational velocities, a supporting roller carried by said apparatus body to contact an outer peripheral surface of a tube, and sensing means to sense a pressure of said tube against said support roller, said means operatively connected to said supporting roller and to said driving means to regulate said driving means in relation to said sensed pressure, wherein an outside diameter of said tube is controlled within desired limits as a function of said varying rotational velocities.

9. An apparatus as defined by claim 7 and further characterized by, said driving means being adjustable in part with said adjustable part connected to said inner drive shaft to drive said shaft at a varying rotational velocity, and sensing means carried by said apparatus to contact said tube to sense a pressure between said means and said tube, said sensing means operatively connected to said driving means to regulate said driving means in relation to said sensed pressure, wherein a diameter of said tube is regulated as a function of said sensed pressure.

10. An apparatus as defined by claim 9 and further characterized by, said sensing means including a roller rotatively carried by said apparatus and positioned to engage an outer surface of said tube.

11. An apparatus for producing a tube from a continuous corrugated strip by coiling said strip into convolutions and joining adjacent edges of said incoming strip and said convolutions comprising, a. an apparatus body, b. an inner connecting roller including a first and second roller part, said first roller part rotatively carried on an inner drive shaft of said apparatus body and said second roller part fixedly carried on said shaft, said first and second roller parts having a series of circumferent grooves formed with an apex and a groove bottom, c. a circular hooking disk having a series of outwardly projecting camming projections and being rotatively carried in an annular space in said second roller part of said inner connecting roller, d. an outer connecting roller including a first and second roller part being fixedly carried by an outer drive shaft of said apparatus body, said first and second roller parts having a series of circumferent grooves formed with an apex and a groove bottom and said grooves positioned to have said apex align with said groove bottom of said inner connecting roller grooves, e. a flattened groove formed in said second roller part of said outer connecting roller and positioned to align with said disk and provide a support surface for said camming projections of said disk, and f. driving means operatively connected to said inner and outer drive shafts to rotate said shafts at varying rotational velocities, wherein a diameter of said formed tube is regulated as a function of said rotational velocity of said inner and outer drive shafts and said camming projections form a hooking joint between said edges of said incoming strip and said adjacent convolution.

* * * * *